United States Patent [19]

Repetto

[11] 4,244,201

[45] Jan. 13, 1981

[54] FLUID PRESSURE ACTUATED DEVICE

[75] Inventor: Silvio Repetto, Modena, Italy

[73] Assignee: S.p.A. Luigi Rizzi & C., Modena, Italy

[21] Appl. No.: 939,850

[22] Filed: Sep. 5, 1978

[30] Foreign Application Priority Data

Sep. 15, 1977 [IT] Italy ..... 27586 A/77

[51] Int. Cl.[3] ..... F01B 9/00; B21B 13/02; C14B 1/14; F15B 15/22

[52] U.S. Cl. ..... 69/9; 29/116 R; 91/408; 92/136

[58] Field of Search ..... 92/136; 91/408, 407; 69/9, 10; 29/116 R

[56] References Cited

U.S. PATENT DOCUMENTS

| | | | |
|---|---|---|---|
| 1,134,648 | 4/1915 | Spencer | 92/136 |
| 1,183,758 | 5/1916 | O'Brien | 69/10 |
| 1,594,875 | 8/1926 | Brenner | 69/9 |
| 1,670,535 | 5/1928 | Gottscholk | 91/408 |
| 2,224,708 | 12/1940 | Von Sittert | 92/136 |
| 2,446,211 | 8/1948 | Clark | 29/116 R |

*Primary Examiner*—Paul E. Maslousky
*Attorney, Agent, or Firm*—Kurt Kelman

[57] ABSTRACT

A fluid pressure actuated device for use with material splitting machines of the type described, the device comprising a cylinder, a double acting piston movable in the cylinder by pressurized fluid, the piston being operatively connectable to the pressure roller of the machine for, in use, effecting withdrawal of the pressure roller from a cutting plane in response to movement of the piston from a first extreme position towards a second extreme position, said cylinder having first and second ports communicating with opposite ends of the piston and arranged so that in use pressurized fluid applied to the first port while the second port is connected to exhaust will cause the piston to move from said first extreme position to said second extreme position so as to effect maximum withdrawal of the pressure roller to permit cleaning of the scrapers and the cutting region, and a third port between the first and second ports and arranged so that in use pressurized fluid applied to the first port while the third port only is connected to exhaust will cause the piston to move from said first extreme position to a position between the first and second extreme positions so as to effect limited withdrawal of the pressure roller to permit insertion of the material.

4 Claims, 2 Drawing Figures

FLUID PRESSURE ACTUATED DEVICE

Figure 1:
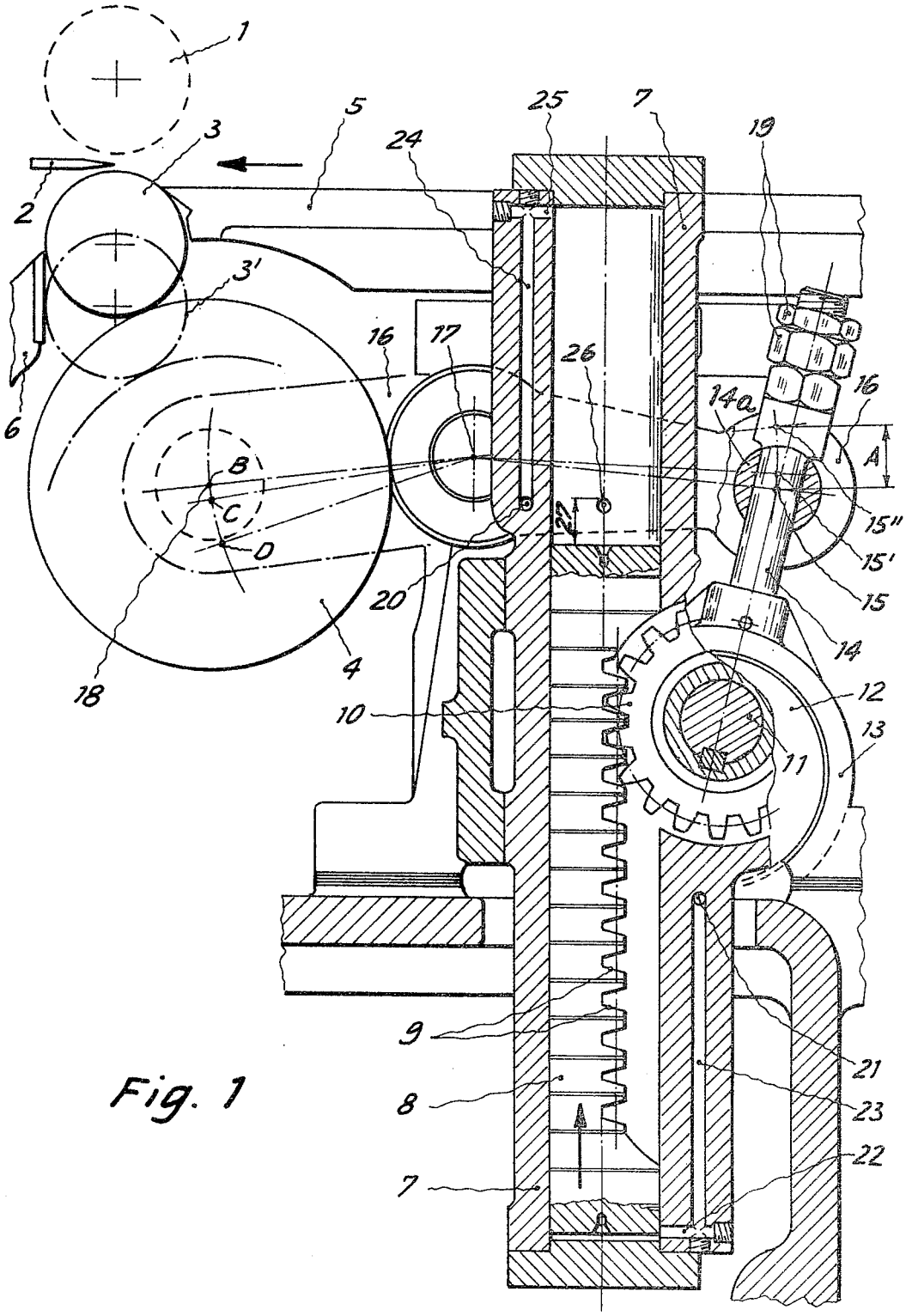

This invention relates to a fluid pressure actuated device for use with a material splitting machine of the type having a band blade for splitting the material (such as hide leather or the like), a gauging roller, an assembly comprising a ring roller and a pressure roller at least the outer surface of which is formed of or coated with friction material (such as rubber) and one or more scrapers normally in contact with the ring roller, the material to be split being disposed between the gauging roller and the pressure roller during normal operation of the machine. There are known to exist various types of machines for splitting hides or the like, i.e. for separating the hides into two parts according to their thickness, namely a part of gauged thickness comprising the outer side of the hide, commonly known as the "grain", and an inner part known as the "split".

In general, these machines comprise a working surface on which the hide to be split is fed by two overlying cylindrical rollers against a rotating band blade. The upper roller is a drive roller and is positioned, relative to the taut line of the blade, so that it can be adjusted according to the cutting thickness required, whereas the lower roller is idly mounted and is constituted by a set of cylindrical rings disposed side-by-side and kept aligned against a straight edge or another suitable system, its purpose being to apply to the processed hide a pressure which is constant independently of the variations in thickness of the hide. The constant pressure derives from a peripherally rubber-coated pressure roller disposed in contact with the ring roller and which rotates it by friction. The ring roller is mounted such that it can rock, i.e. is rotatably supported by the rubber-coated roller and by lateral guide elements which, because of their special shape, constitute scrapers or members in contact with the surface of the ring cylinder to remove the threads of hide and/or shreds of flesh produced by the cutting operation. Devices have already been proposed for making it possible to clean the scrapers and the cutting members and drive rollers generally, some of these devices raising or displacing the upper gauging roller to make the cutting region accessible in order to effect cleaning.

However, these know devices do not allow easy cleaning of those edges of the scrapers in contact with the lower ring roller, i.e. those parts on which the shreds of flesh and/or the crust most easily accumulate.

An object of the present invention is to provide a fluid pressure actuated device which both allows cleaning of the scrapers and the entire cutting region, and facilitates initial insertion of the hide against the cutting blade.

The invention provides a fluid pressure actuated device for use with material splitting machines of the type described, the device comprising a cylinder, a double acting piston movable in the cylinder by pressurised fluid, the piston being operatively connectable to the pressure roller of the machine for, in use, effecting withdrawal of the pressure roller from a cutting plane in response to movement of the piston from a first extreme position towards a second extreme position, said cylinder having first and second ports communicating with opposite ends of the piston and arranged so that in use pressurised fluid applied to the first port whilst the second port is connected to exhaust will cause the piston to move from said first extreme position to said second extreme position so as to effect maximum withdrawal of the pressure roller to permit cleaning of the scrapers and the cutting region, and a third part between the first and second ports and arranged so that in use pressurised fluid applied to the first port whilst the third port only is connected to exhaust will cause the piston to move from said first extreme position to a position between the first and second extreme positions so as to effect limited withdrawal of the pressure roller to permit insertion of the material.

Advantageously, the invention provides a fluid pressure actuated device for use with splitting machines of the type hereinbefore described, the device comprising a cylinder, a double acting piston movable in the cylinder by pressurised fluid, a rack movable with the piston, a pinion gear co-operating with the rack, a cam connected to the pinion gear for angular movement therewith, and a connecting rod connecting the cam to a lever system which is operatively connectable to the pressure roller of the machine for, in use, a cutting plane in response to movement of the piston from a first position adjacent to a first end of the cylinder towards a second position adjacent to a second, opposite end of the cylinder, said cylinder having first and second ports communicating with the first and second ends of the cylinder and a third port between the first and second ports the arrangement being such that fluid pressure applied to the first port whilst the second port is connected to exhaust, will cause the piston to move from said first position to said second position so as to effect maximum withdrawal of the pressure roller to permit cleaning of the scrapers and cutting region, whereas fluid pressure applied to the first port when the piston is in said first position and whilst the third port only is connected to exhaust will cause the piston to move from said first position to a position in which it closes the third port and between said first and second positions so as to effect limited withdrawal of the pressure roller to permit insertion of the material.

Figure 2:
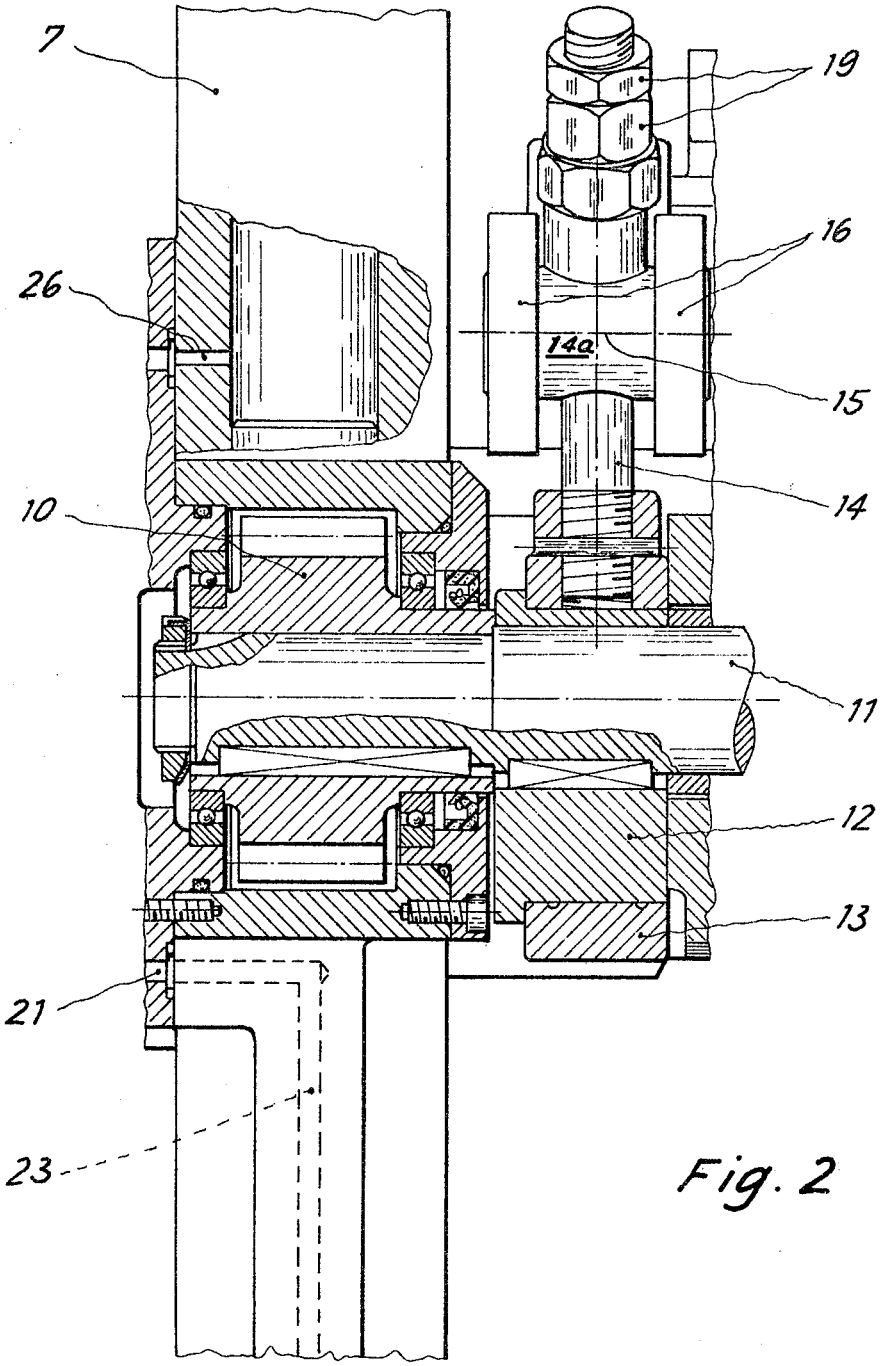

The invention will now be more particularly described with reference to the accompanying drawings, wherein:

FIG. 1 is a longitudinal sectional view of one embodiment of a device according to the invention, and connected to an assembly comprising a rubber-coated roller and a ring roller of a machine with a band blade for splitting hides, leather or the like, and FIG. 2 is a longitudinal section, taken at 90° to the FIG. 1, passing through the axis of the pinion gear and through the cam operating the connecting rod.

With reference to the drawings, the device is connected to a hide splitting machine, of which only the cutting region is shown diagrammatically.

FIG. 1 shows a normal upper gauging roller 1, a band cutting blade 2 and a roller 3 of the type comprising side-by-side rings kept aligned by a straight edge or the like (not shown). The pressure roller 4, rubber-coated peripherally, rotates the ring roller 3 by friction. Normal scrapers, which also act as a guide for the ring roller 3, are indicated by 5 and 6. The hydraulic device comprises an elongated cylinder 7 in which a double acting piston 8 moves. On the body of the piston 8, a rack 9 is provided axially and its form is such that the necessary seal can be made with the cylinder at the two ends of the piston. A pinion gear 10, engaging with the rack 9, is mounted on a rotatable shaft 11, the axis of which is perpendicular to the axes of the cylinder 7 and piston 8.

On the shaft 11, there is keyed to the side of the pinion 10 a cam 12 (FIG. 2) on which there is mounted a ring 13 which substantially forms the big end of a connecting rod 14. The free end of the connecting rod 14 passes through coupling 14*a* which is pivoted at 15 and connected to one end of a rocker lever 16, which is pivoted at 17 to a rigid support and which has its other end connected rotatably to a support shaft of the rubber-coated roller 4, the axis of which is indicated by 18 in FIG. 1.

The connecting rod 14 is provided at its free end, beyond pivot 15, with two nuts 19. In the body of the cylinder 7 there are provided ports for the entry and discharge of pressurised fluid, which is fed and discharged through conduits 20 and 21 connected to a central hydraulic unit (not shown).

In particular, at the base of the cylinder 7 there is provided a port 22 which enables the pressurised fluid to reach the base of the cylinder 7 via the lower communication passage 23. The pressurised fluid is fed to the upper region of the cylinder via the upper communication passage 24 and the port 25.

A further discharge port 26 communicates with the central hydraulic unit by known means, the position of said port 26 being such that it is just a short distance from the crown of the piston 8 when the piston is in its lower end position (as shown in FIG. 1), for the reasons which will be clarified hereinafter (distance 27).

When under normal working conditions (FIG. 1), the device has its piston in its lower end position under the pressure of the fluid present in the upper chamber of the cylinder, with discharge port 26 closed. Under these conditions, the rubber-coated roller 4 and associated ring roller 3 are under pressure because the rocker lever 16 subjects the roller 4 to a thrust in the direction of the upper cutting line (FIG. 1). The operation of the described device, in causing a first lowering of the roller 4 to facilitate insertion of the hide and a second further lowering of the roller 4 to allow cleaning of the scrapers, is as follows. Starting from the normal working condition as shown in FIG. 1, and with fluid under pressure in the upper chamber of the cylinder 7, pressurised fluid is fed to the base of the piston 8 through the port 22. With the upper port 25 closed and the port 26 connected to exhaust (by known devices) the fluid discharges from the port 26, so enabling the piston to rise, and this discharge of fluid continues until the piston closes port 26. At this point, the piston cannot rise further because of the fluid present in the upper chamber of the cylinder. Simultaneously with the rise of the piston 8, the rack 9 rotates the pinion 10, and this latter, by way of the cam 12 rigid therewith, causes the connecting rod 14 to make a combined lifting and angular displacement movement. The result is that the point 15 at which the connecting rod is pivoted to the rocker lever is moved to 15'.

Consequently, the rocker lever 16 moves angularly about its pivot point 17 to displace the axis of the rubber-coated roller 4 downwards from the working position B to the position C. The partial upward movement of the piston 8 and its stoppage after closing the port 26 therefore causes the rubber-coated roller 4 to drop accompanied by an equal drop (under its own weight) of the ring roller 3. Thus it becomes possible and easy to insert the hide between the rollers 1 and 3.

If the pressurised fluid is further fed to the base of the piston through the port 22, and if the upper port 25 is opened and connected to exhaust, the piston will rise until it reaches its upper end limit, so causing the connecting rod 14 to move, for example by a distance A (FIG. 1), so that the point 15 is displaced to 15". Consequently, the rubber-coated roller 4 moves further downwards until its axis 18 is in the position D. With the roller 4 in this position, the ring roller 3 will fall to 3' to expose the scrapers 5, 6 for cleaning. If the fluid is then fed into the top part of the cylinder, the piston returns to its lower end position so that the roller 4 reassumes its normal operating position.

In practice, the device according to the invention enables the rubber-coated roller 4 to undergo a maximum displacement corresponding to about 180° of rotation of the pinion gear 10. Structurally and operationally equivalent modifications can be made to the invention heretofore described, without departing from the scope of the invention.

What we claim is:

1. A material splitting machine which includes a cutting region for a material to be split, a ring roller in said cutting region for applying pressure to the material, scrapers associated with, and arranged to guide the ring roller, a pressure roller acting on the ring roller, and a fluid pressure actuated device comprising a cylinder, a double acting piston movable in the cylinder by pressurized fluid, a rack movable with the piston, a pinion gear co-operating with the rack, a cam connected to the pinion gear for angular movement therewith, a lever system connected to the pressure roller and a connecting rod connecting the cam to the lever system for effecting displacement of the pressure roller from the cutting region in response to movement of the piston from a first position adjacent to a first end of the cylinder towards a second position adjacent to a second, opposite end of the cylinder, said cylinder having first and second ports communicating with the first and second ends of the cylinder and a third port between the first and second ports, conduit means for respectively connecting the ports to a source of fluid pressure and to exhaust, the arrangement being such that connection of the first port to the fluid pressure source while the second port is connected to exhaust will cause the piston to move from said first position to said second position so as to effect maximum displacement of the pressure roller, whereas connection of the fluid pressure source to the first port when the piston is in said first position and while the third port only is connected to exhaust will cause the piston to move from said first position to a position in which it closes the third port and between said first and second positions so as to effect limited displacement of the pressure roller.

2. The machine as claimed in claim 1, wherein the rack is formed in an axially extending direction on the piston and engages the pinion gear over a path equal to an angular displacement of the pinion gear of substantially 180°.

3. The machine as claimed in claim 1, wherein said lever system comprises a rocker lever pivoted about a fixed point.

4. The machine as claimed in claim 1, wherein the connecting rod is pivotably connected to the lever system.

* * * * *